United States Patent [19]

McGlew

[11] Patent Number: 4,496,150

[45] Date of Patent: Jan. 29, 1985

[54] GOLF BALL EJECTOR FOR GOLF GREEN HOLE LINER

[76] Inventor: John J. McGlew, Box 823, Tuxedo Park, N.Y. 10987

[21] Appl. No.: 398,597

[22] Filed: Jul. 15, 1982

[51] Int. Cl.[3] ..... A63B 57/00

[52] U.S. Cl. ..... 273/34 A

[58] Field of Search ..... 273/34 A, 179 R, 179 A, 273/179 B, 179 C, 179 D, 179 E, 182 R, 182 A

[56] References Cited

U.S. PATENT DOCUMENTS 1,826,641 10/1931 Waddell ..... 273/34 A

FOREIGN PATENT DOCUMENTS 12566 of 1910 United Kingdom ..... 273/34 A

*Primary Examiner*—George J. Marlo

*Attorney, Agent, or Firm*—McGlew and Tuttle

[57] ABSTRACT

A golf ball ejection device for use with a golf course hole liner comprising a golf ball support which is adapted to be positioned in the liner and which will move upwardly to eject the ball out of the liner hole after it is driven into the hole by a golfer. In one embodiment, the ball is received on a support plate which is sloped so that the ball moves downwardly from the center toward a peripheral wall of the liner. In another embodiment, the liner is provided with a guideway along which the ball travels to a lowermost point in the liner when it is driven into the hole by a golfer. Upon arrival at the lowermost point, it enters on a support plate and moves a trigger to cause the support plate to be moved upwardly rapidly and propel the ball out of the liner. When a ball is driven into the hole of the liner, it moves down the plate against the trigger mechanism to release the plate and to cause the plate to move upwardly and deposit the ball on the green. With all of the devices, an indicator or flag is advantageously provided which will be actuated by the entrance of the ball to show that a ball has, in fact, been driven into the hole.

5 Claims, 5 Drawing Figures

GOLF BALL EJECTOR FOR GOLF GREEN HOLE LINER

FIELD AND BACKGROUND OF THE INVENTION

This invention relates, in general, to golfing and, in particular, to a new and useful device for causing a golf ball which is driven into a hole on a green to be moved upwardly out of the hole liner and be presented on the green a level above the bottom of the liner at which it is more accessible to the golfer.

In the playing of the game of golf, after the golfer strokes the golf ball so that it enters into a hole, it is usually very difficult to stoop down by an amount sufficient to permit the golfer to reach his hand into the hole to remove the golf ball so that he can use it to play the next tee. It would be very helpful, indeed, if the ball is moved out of the hole by some mechanism so that it is presented at the level of the gound or the grass of the green so that it can be easily picked up.

SUMMARY OF THE INVENTION

In accordance with the invention, a golf ball support is provided for association with a hole liner which is positioned in the liner so that a golf ball driven in that particular hole with which the liner is used will fall onto the golf ball support. Means are associated with the support to cause the support to move upwardly to eject the golf ball onto the green at ground level so that it will be more accessible to the golfer. In one embodiment, this comprises, for example, a fluid pressure system including a piston member which is movable downwardly under the engagement of it by a golf pole to cause a support connected to the fluid system to move upwardly with the golf ball in the hole liner and to eject it at the ground level. In accordance with another embodiment of the invention, the golf ball guideway is positioned in the liner and mounted in respect to the liner so that it moves upwardly and downwardly. When a ball is stroked into the hole it moves down along the guideway to a lowermost point on the guideway. The guideway is mounted so that the support play at the lowermost end of the guideway will be moved upwardly for example by the action of a spring to present the ball at a height higher than the ground level so as to move the ball out of the hole and onto the green. In a further arrangement, the guideway and the support platform which receives the ball from the guideway at the bottom of the liner is mounted in the lower end of the liner and just the support plate upon which the golf ball will rest as a result of its movement by gravity will be moved rapidly by spring power to cause the ejection of the ball from the hole. In this latter embodiment, it is preferable that this support plate is angled somewhat so that the ball will receive the lateral projection causing it to move out of the liner or cup and onto the ground rather than back into the cup. In each case, the ejection mechanism provides a portion which projects from the top of the hole to provide an indicator that a ball has actually been in the cup. This is necessary because when the ball enters the hole, it moves downwardly to the support plate and actuates a trigger to release the support plate so that the ball will be moved out of the liner.

In a still further embodiment of the invention, the support for the ball and the liner comprises an inclined plate which, for example, may be of cylindrical construction and mounted in the liner for upward and downward movement therein. The plate is pushed downwardly by a flag pole to a lowermost position at which time a trigger holding mechanism becomes engaged with an opening in the side of the liner to hold the plate in position. When a golf ball enters the hole, it moves downwardly on the plate and actuates the trigger to release it and permit the spring to push the plate upwardly so that the ball arrives above ground level and may roll off the plate onto the green.

Accordingly, it is an object of the invention to provide an improved device for causing the golf ball which is stroked into a hole to be moved ouwardly and onto a green.

A further object of the invention is to provide a golf ball device associated with a hole liner which is capable of moving a golf ball driven into the liner upwardly and onto the green.

A still further object of the invention is to provide a device for facilitating the removal of a golf ball from a hole liner which is simple in design, rugged in construction and economical to manufacture.

The various features of novelty which characterize the invention are pointed out with particularity in the claims annexed to and forming a part of this disclosure. For a better understanding of this invention, its operating advantages and specific objects attained by its uses, reference is made to the accompanying drawings and descriptive matter in which preferred embodiments of the invention are described and illustrated.

GENERAL DESCRIPTION OF THE PREFERRED EMBODIMENTS

Figure 1:
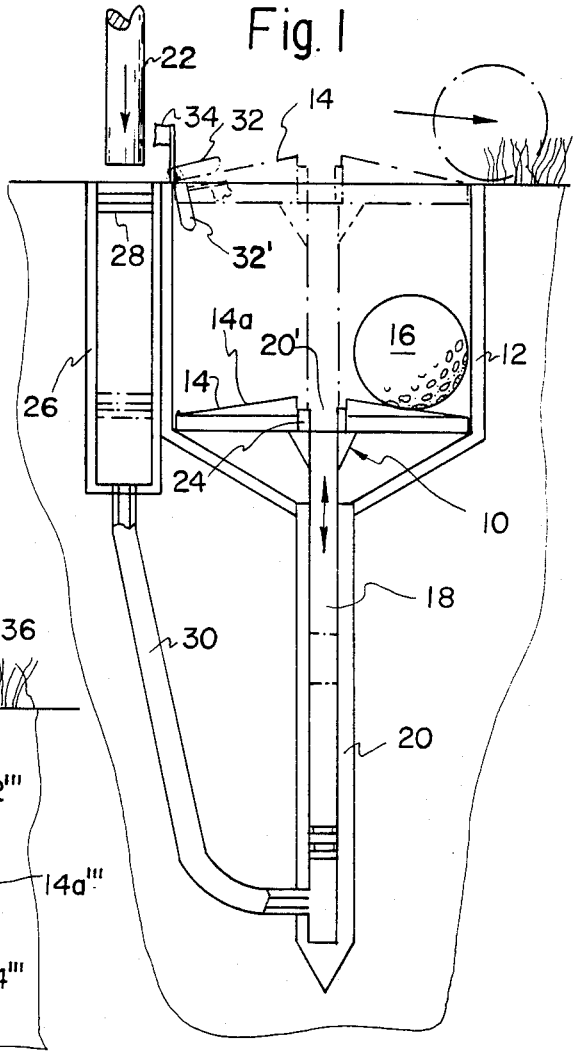
FIG. 1 is a sectional view of a golf hole aligner having a ball ejector constructed in accordance with the invention.

Referring to the drawings, in particular, the invention embodied therein in FIG. 1 comprises a golf ball ejection device generally designated 10 which is associated with the usual hole liner 12 employed on golf course greens and putting greens of golf courses.

In accordance with the invention, the golf ball ejector 10 comprises a support plate 14 having an inclined top surface 14*a* onto which a golf ball 16 will fall when it is driven by a golfer into the cup or hole which is surrounded by the liner 12. The support plate 14 is carried on a rod or piston member 18 which rides in a cylinder 20 formed as a lower extension of the liner 12. Plate 14 has a central opening 20' which is large enough to permit insertion of a flag pole rod 22 through the plate and into a support collar 24 held at the center of the liner by a web portion of the liner (now shown).

In accordance with the invention, the golf ball 16 is ejected from the bottom of the hole where it rests on the suppot plate 14 by moving the entire support plate up from the solid line position shown in FIG. 1 to the dotted line position shown.

Support plate movement means, in the embodiment of FIG. 1, comprises actuator cylinder 26 having a piston 28 movable therein which is moved downwardly to cause upward movement of the rod piston 18 carrying the support plate by an amount to bring it up to the top of the hole liner 12. For this purpose, the cylinder 26 may comprise a hydraulic cylinder which is connected through a connecting line 30 to the cylinder 20'. Actuator means for moving the piston 28 advantageously comprises the flag pole 22 which may be pressed against piston 28 to cause its downward movement and the upward movement of the support plate 14.

When the support plate moves upwardly above the rim of the liner 12, it displaces a pivot arm 32 of an actuator or actuating lever 32' which is connected to a small indicating flag 34 and causes it to project upwardly to show and provide a record that a golf ball has been ejected from the hole liner. Due to the inclination 14*a*, the golf ball 16 moves off the support and is presented on the turf 36 where it may be easily grabbed by a golf player. The indicator flag 34 is desirable in order to indicate that the golf ball has, in fact, entered into the cup, but that it has been ejected from the cup.

Figure 2:
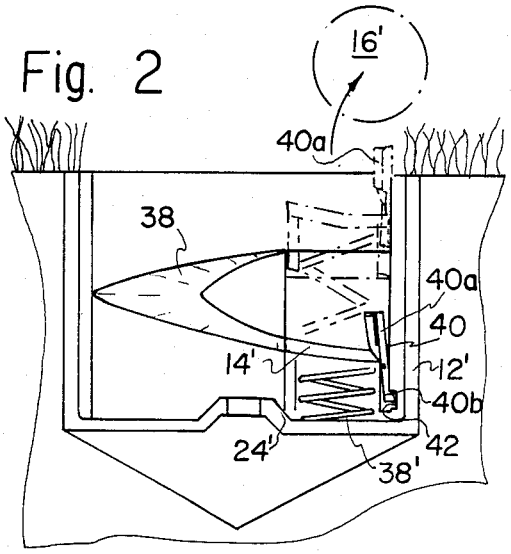
FIG. 2 is a view similar to FIG. 1 of another embodiment of the invention.
Figure 3:
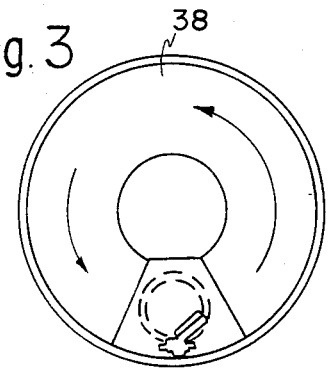
FIG. 3 is a top plan view of the device shown in FIG. 2.

In accordance with the embodiment of the invention shown in FIGS. 2 and 3, there is provided a hole liner 12' having a hollow support 24' similar to the embodiment in FIG. 1. In this embodiment, a curved guide 38 is disposed in the liner and when a golf ball enters the guide, it moves down around the curved guide onto a bottom support plate 14' which is carried on a spring 38' which, when it relaxes, will move the plate up from the solid line position to the dotted line position. Support plate movement means in the embodiments of FIGS. 2 and 3 comprises an actuating lever 40 having one arm portion 40*a* which is disposed above the support plate 14' in a position to be moved by a golf ball which arrives thereon and another arm portion 40*b* which is engaged in a recess 42 of the liner 12'. The arm 40*b* is moved out of the recess upon movement of the arm portion 40*a* by the ball to cause the support 14' to move upwardly with sufficient force to eject the ball 16' out of the hole. In the uppermost position of the support plate, the actuator arm portion 40*a* forms a flag indicator showing that the ball has once been in the hole.

Figure 4:
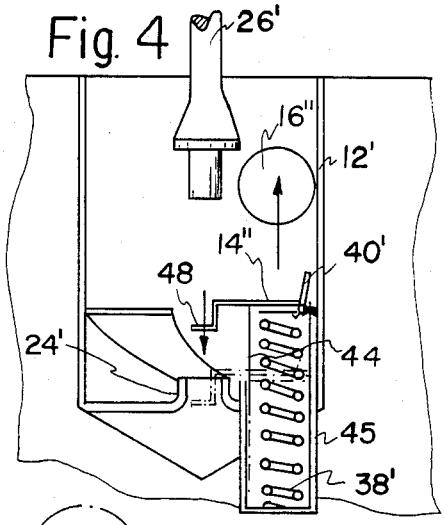
FIG. 4 is a view similar to FIG. 1 of still another embodiment of the invention.

In the embodiment of the invention shown in FIG. 4, a support plate 14'' is carried on a cylinder 44 which is telescopic within an outer cylinder 45 held at the bottom of the liner 12''. An actuating spring 38' is sized to give sufficient force to the support plate 14'' to eject the ball 16'' out of the liner hole. Support plate movement means includes an actuator lever 40' which is similar to the embodiment of FIGS. 2 and 3, but in this arrangement, the support plate 14'' only moves upwardly a discrete distance and does not appear at the top of the liner after it ejects the ball. In both the embodiments of FIGS. 2 and 3, and also FIG. 4 a flag pole 26' may be inserted into a collar support 24'. In the embodiment of FIG. 4, the insertion of the flag pole into the support will cause the resetting of the support plate 14'' as it contacts a plate tab 48 secured to an extension of the support plate 14'' which will cause the lever 40' to engage in a recess after the spring 38' has been tensioned by the depression produced by the flag pole.

Figure 5:
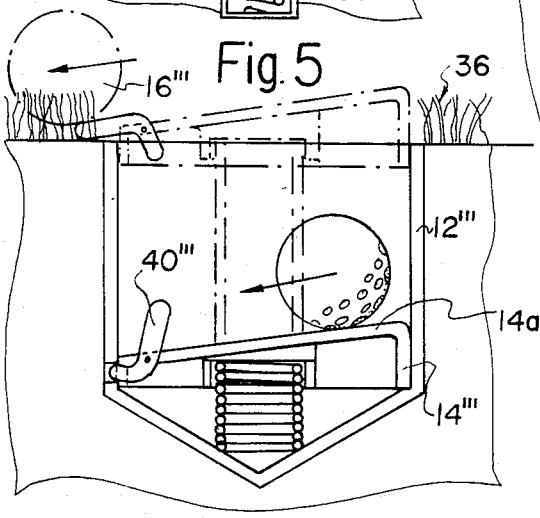
FIG. 5 is a view similar to FIG. 1 of still another embodiment of the invention.

In the embodiment of the invention shown in FIG. 5, the golf liner 12''' is provided with an inclined support plate 14''' in the form of a cylinder having an inclined surface 14*a*'''. Support plate 14*a*''' may be moved upwardly from the solid line position to the dotted line position shown by a golf ball 16''' contacting an actuating lever 40'''. In each embodiment, the golf ball is presented at the level of the turf 36, but the golfer does not have to reach all the way downward into the hole in order to pick it out of the hole.

While specific embodiments of the invention have been illustrated and described in detail to illustrate the application of the principles of the invention, it will be understood that the invention may be embodied otherwise without departing from such principles.

What is claimed is:

1. A golf ball ejection device for use with a golf course hole liner such as used in golf course greens and putting greens, comprising a golf ball support adapted to be positioned in the liner, and means associated with said golf ball support for enabling a golf ball entering said cup to actuate a release which allows said support to be moved upwardly to eject a golf ball which has entered into the hole liner and move it out of the liner, and indicator means associated with said ball support for recording when a ball has been ejected out of the liner.

2. A golf ball ejection device according to claim 1, wherein said ball support comprises a plate located in said liner, and actuator means connected to said plate to move said plate upwardly in said liner to the top thereof.

3. A golf ball ejection device according to claim 1, wherein said ball support comprises a plate disposed within said liner, guide means in said liner for guiding the ball to said plate, said means for moving said plate comprising a spring biasing said plate upwardly, an ejection lever carried by said support plate and having an arm portion matchable to said liner and an opposite arm portion engageable by a golf ball to release said latchable arm portion and cause said spring to move said plate upwardly to eject a ball from the liner and a flag on said lever comprising said recording means.

4. A golf ball ejection device according to claim 1, wherein said support plate is moved by said spring up to a position adjacent the top of said liner.

5. A golf ball ejection device according to claim 1, wherein said ball support comprises an inner cylinder member, an outer cylinder member held by said liner, said inner spring acting on said cylinder member to move it upwardly in said outer cylinder.

* * * * *